US009249973B2

(12) United States Patent
Machii et al.

(10) Patent No.: US 9,249,973 B2
(45) Date of Patent: Feb. 2, 2016

(54) MOISTURE SEPARATOR AND REHEATER

(75) Inventors: Kotaro Machii, Tokyo (JP); Noriko Tomii, Takasago (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 661 days.

(21) Appl. No.: 13/338,531

(22) Filed: Dec. 28, 2011

(65) Prior Publication Data

US 2013/0000567 A1 Jan. 3, 2013

(30) Foreign Application Priority Data

Jun. 30, 2011 (JP) ..... 2011-145402

(51) Int. Cl.
*F22G 1/00* (2006.01)
*F22G 3/00* (2006.01)
*F01K 7/22* (2006.01)

(52) U.S. Cl.
CPC ..... *F22G 3/006* (2013.01); *F01K 7/223* (2013.01)

(58) Field of Classification Search
CPC ..... F01K 7/223; F22G 3/006; F22G 3/003; F22B 37/266
USPC ..... 122/483, 34, 488; 165/110; 55/318
See application file for complete search history.

(56) References Cited

U.S. PATENT DOCUMENTS 3,713,278 A * 1/1973 Miller et al. ..... 55/418.1
4,019,881 A * 4/1977 Herzog et al. ..... 55/459.2
4,302,227 A * 11/1981 Miller ..... 55/434.4
4,842,811 A * 6/1989 Desilva ..... 376/301
5,653,474 A * 8/1997 Ninacs et al. ..... 285/47
2005/0116435 A1* 6/2005 Nishiura et al. ..... 280/124.109
2007/0186874 A1* 8/2007 Yousoufian ..... 122/488

FOREIGN PATENT DOCUMENTS

JP 03-199803 8/1991
JP 2009-062902 * 3/2009

OTHER PUBLICATIONS

Japanese Notice of Allowance issued Feb. 3, 2015 in corresponding Japanese Patent Application No. 2011-145402 with English translation.

* cited by examiner

*Primary Examiner* — Alissa Tompkins
*Assistant Examiner* — Benjamin W Johnson
(74) *Attorney, Agent, or Firm* — Wenderoth, Lind & Ponack, L.L.P.

(57) ABSTRACT

There are formed inside a casing, a steam receiving chamber, a supply manifold chamber, a moisture separating chamber, a heating chamber adjacent to the steam receiving chamber in an axial direction and housing a heat exchanger tube group, and a collection manifold chamber communicating with the heating chamber and adjacent to an upper part of the steam heating chamber. The steam receiving chamber and the partition panel are separated by a transverse partition panel which extends in a vertical direction and through which an end of the heat exchanger tube group in the axial direction penetrates, and a shroud that shrouds the end of the heat exchanger tube group penetrating the transverse partition panel. The steam receiving and the collection manifold chambers are separated by a ceiling panel. A panel bonded to the ceiling panel, the transverse partition panel, and the shroud is provided in the steam receiving chamber.

2 Claims, 7 Drawing Sheets

MOISTURE SEPARATOR AND REHEATER

TECHNICAL FIELD

The present invention relates to a moisture separator and reheater that generates superheated steam by separating moisture from steam and heating the steam. Priority is claimed on Japanese Patent Application No. 2011-145402, filed Jun. 30, 2011, the content of which is incorporated herein by reference.

BACKGROUND ART

In a power generation plant, steam used in a high-pressure steam turbine may be used again in a low-pressure steam turbine. In this case, if there is moisture (about 12%) in the steam, not only the turbine blades of the low-pressure steam turbine are corroded but also the thermal efficiency of the turbine decreases. In this case, a moisture separator and reheater that generates superheated steam by separating moisture from steam discharged from a high-pressure steam turbine and heating the steam is provided between the high-pressure steam turbine and the low-pressure steam turbine.

As such a moisture separator and reheater, for example, there is one disclosed in the following Patent Document 1.

This moisture separator and reheater includes a cylindrical casing extending in a horizontal axial direction, with opposite ends in the axial direction being sealed, and heat exchanger tubes that heat steam entering into the casing. A steam receiving port is formed in a lower part of the casing, and a steam discharge port is formed in an upper part of the casing. Inside the casing there are formed: a steam receiving chamber into which steam flowing in from the steam receiving port enters; a supply manifold chamber communicating with the steam receiving chamber and adjacent to the steam receiving chamber in the axial direction; a moisture separating chamber communicating with the supply manifold chamber and adjacent to a lower part of the supply manifold chamber for separating moisture from steam; a heating chamber communicating with the moisture separating chamber, adjacent to the steam receiving chamber in the axial direction, and housing the heat exchanger tubes; and a collection manifold chamber communicating with the heating chamber and the steam discharge port and adjacent to the heating chamber and an upper part of the steam heating chamber. The steam receiving chamber and the collection manifold chamber are separated by a ceiling panel.

PRIOR ART DOCUMENT

Patent Document

[Patent Document 1]

[Patent Document 1] Japanese Unexamined Patent Application, First Publication No. 2009-62902

DISCLOSURE OF INVENTION

Problems to be Solved by the Invention

In the moisture separator and reheater described in Patent Document 1, there is a pressure difference between the steam receiving chamber and the collection manifold chamber. Therefore a strength capable of sufficiently enduring the force caused by the pressure difference is required for the ceiling panel. Particularly, when the steam generation amount is large as in a nuclear power generation plant, the casing of the moisture separator and reheater becomes large and the area of the ceiling panel also increases. Consequently, a force applied to the ceiling panel due to the pressure difference between the steam receiving chamber and the collection manifold chamber increases, and higher strength reliability is required for the ceiling panel.

In view of the above situation, it is therefore an object of the present invention to provide a moisture separator and reheater that can increase the strength reliability of the ceiling panel.

Means for Solving the Problems

In order to achieve the above object, the moisture separator and reheater according to the present invention comprises; a cylindrical casing extending in a horizontal axial direction with opposite ends in the axial direction being sealed, and a heat exchanger tube group that heats steam entering into the casing. A steam receiving port for receiving steam from outside is formed in a lower part of the casing, and a steam discharge port for discharging steam to outside is formed in an upper part of the casing. Inside the casing, there are formed: a steam receiving chamber into which steam flowing in from the steam receiving port enters; a supply manifold chamber communicating with the steam receiving chamber and adjacent to the steam receiving chamber in the axial direction; a moisture separating chamber communicating with the supply manifold chamber and adjacent to a lower part of the supply manifold chamber for separating moisture from steam; a heating chamber communicating with the moisture separating chamber, adjacent to the steam receiving chamber in the axial direction, and housing the heat exchanger tube group; and a collection manifold chamber communicating with the heating chamber and the steam discharge port and adjacent to the heating chamber and an upper part of the steam receiving chamber. The steam receiving chamber and the heating chamber are separated by a partition panel which extends in a vertical direction and through which an end of the heat exchanger tube group in the axial direction penetrates, and a shroud that shrouds the end of the heat exchanger tube group penetrating the partition panel, and that is bonded to the partition panel. The steam receiving chamber and the collection manifold chamber are separated by a ceiling panel bonded to the partition panel, and a reinforcing panel bonded to the shroud or integrally formed with a part of the shroud and bonded to the ceiling panel and the partition panel is provided in the steam receiving chamber.

In the moisture separator and reheater, the ceiling panel receives a force directed toward the collection manifold chamber side, that is, a force directed upward, due to a pressure difference between the steam receiving chamber and the collection manifold chamber. When the reinforcing panel is not provided, if the ceiling panel receives this force, a stress concentrates at a corner portion where the ceiling panel and the partition panel come in contact with each other.

On the other hand, in the moisture separator and reheater, since the reinforcing panel bonded to the ceiling panel and the partition panel is provided, the stress applied to the corner portion where the ceiling panel and the partition panel come in contact with each other can be dispersed to a portion along a peripheral edge of the reinforcing panel.

Further, in the moisture separator and reheater, the reinforcing panel is arranged in the steam receiving chamber surrounded by the ceiling panel, the partition panel, and the side shroud, where steam flowing into the steam receiving chamber stagnates. Therefore, the reinforcing panel does not become a flow resistance to the steam, and does not have harmful effects on moisture separation and heating performance.

In the moisture separator and reheater, the shroud preferably has a pair of side shrouds facing each other on opposite sides in a widthwise horizontal direction perpendicular to the axial direction with the ends of the heat exchanger tube group as a reference, and a connecting shroud that connects edges of the pair of side shrouds to each other. The reinforcing panel is preferably bonded to the side shroud or integrally formed with the side shroud.

In the moisture separator and reheater, by bonding the reinforcing panel to the side shroud having a relatively high vertical stiffness, time and labor for separately providing a member having stiffness with respect to a vertical force received from the reinforcing panel, being a member to be bonded with the reinforcing panel, can be saved. Moreover, if the reinforcing panel and the side shroud are integrally formed when the shroud itself is newly manufactured, the number of parts can be reduced, while maintaining support stiffness of the reinforcing panel.

Moreover, in the moisture separator and reheater, it is desired that an edge of the reinforcing panel on an opposite side to the partition panel to which the reinforcing panel is bonded, has a concave shape depressed toward the partition panel side within a plane extending vertically.

If the edge of the reinforcing panel on the opposite side to the partition panel has the concave shape, the vicinity of the edge of the reinforcing panel is more easily deformed vertically with respect to a force in the vertical direction V. Consequently, when the ceiling panel receives an upward force, the vicinity of the edge of the reinforcing panel deforms vertically, thereby enabling to release the stress applied to the corner portion between the edge and the ceiling panel.

Moreover, in the moisture separator and reheater, the concave shape of the reinforcing panel is preferably a circular arc shape.

If the edge of the reinforcing panel has the circular arc shape, the stress applied to the portion along the edge of the reinforcing panel can be made uniform.

Furthermore, in the moisture separator and reheater, an arc center of the circular arc shape of the reinforcing panel is preferably positioned further on the partition panel side than a remote position farthest from the partition panel in the shroud to which the reinforcing panel is bonded.

In the moisture separator and reheater, the entire edge of the reinforcing panel on the shroud side can be bonded to the shroud, and hence, the reinforcing panel can be stably bonded to the shroud. Moreover, positioning the arc center of the circular arc shape in vicinity of the partition panel and decreasing the radius of the circular arc, gives a shape in which the size and amount of the edge of the reinforcing panel on the opposite side to the partition panel to be depressed toward the partition panel can be increased, and the vicinity of the edge is more easily deformed vertically with respect to the upward force.

Effect of the Invention

Due to the present invention, stress concentration with respect to the ceiling panel and the member bonded to the ceiling panel can be reduced with respect to an upward force applied to the ceiling panel due to a pressure difference between the steam receiving chamber and the collection manifold chamber, without negatively affecting the steam flow.

That is to say, according to the present invention, the strength reliability of the ceiling panel can be increased without negatively affecting the steam flow.

BEST MODE FOR CARRYING OUT THE INVENTION

Hereunder, one embodiment of a moisture separator and reheater according to the present invention is explained in detail with reference to the drawings.

The moisture separator and reheater of the embodiment separates moisture from steam used in, for example, a high-pressure steam turbine and heats the steam to generate superheated steam, and delivers the superheated steam to a low-pressure steam turbine.

Figure 1:
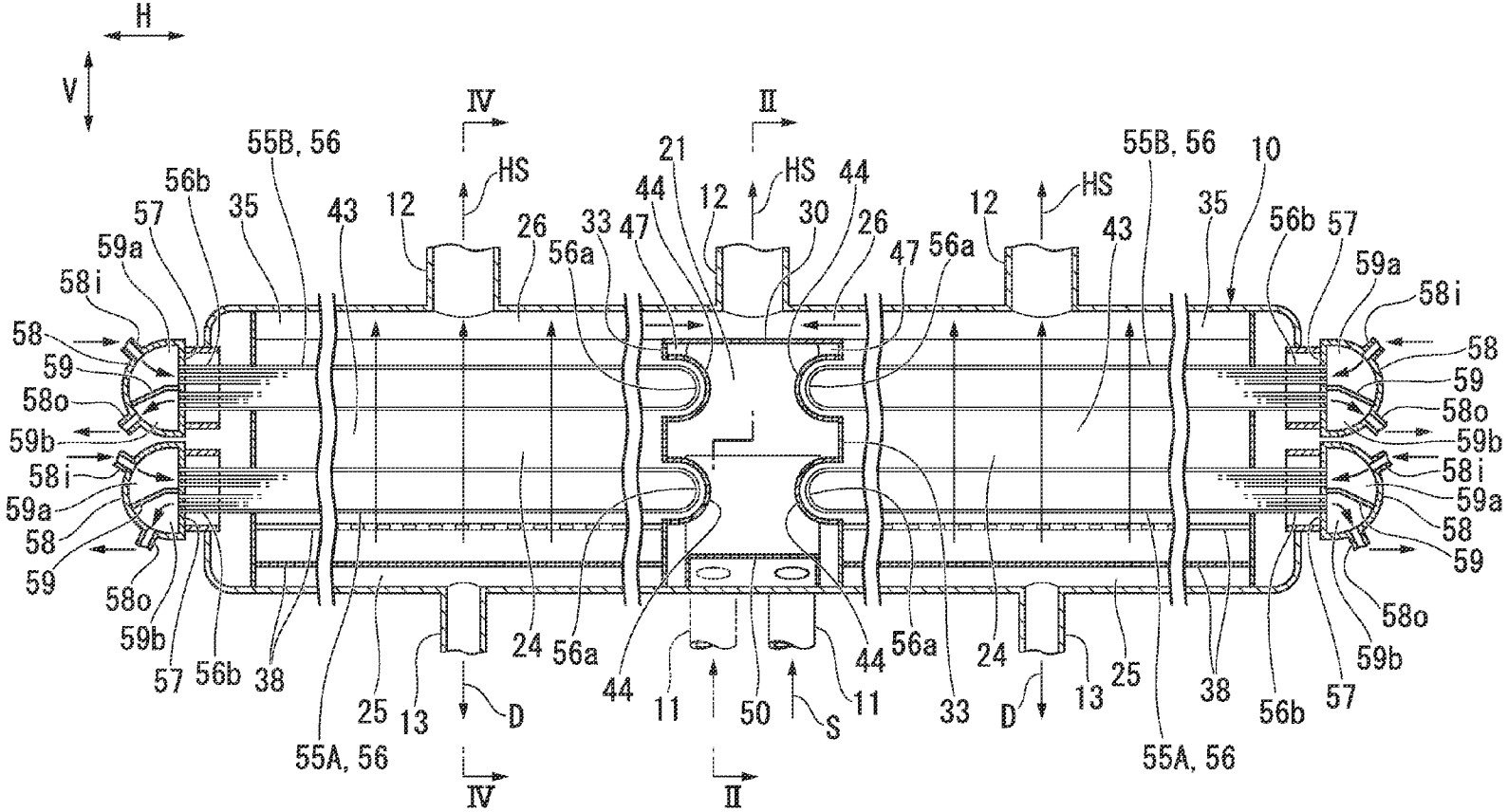
FIG. 1 is a longitudinal sectional view of a moisture separator and reheater according to an embodiment of the present invention.
Figure 2:
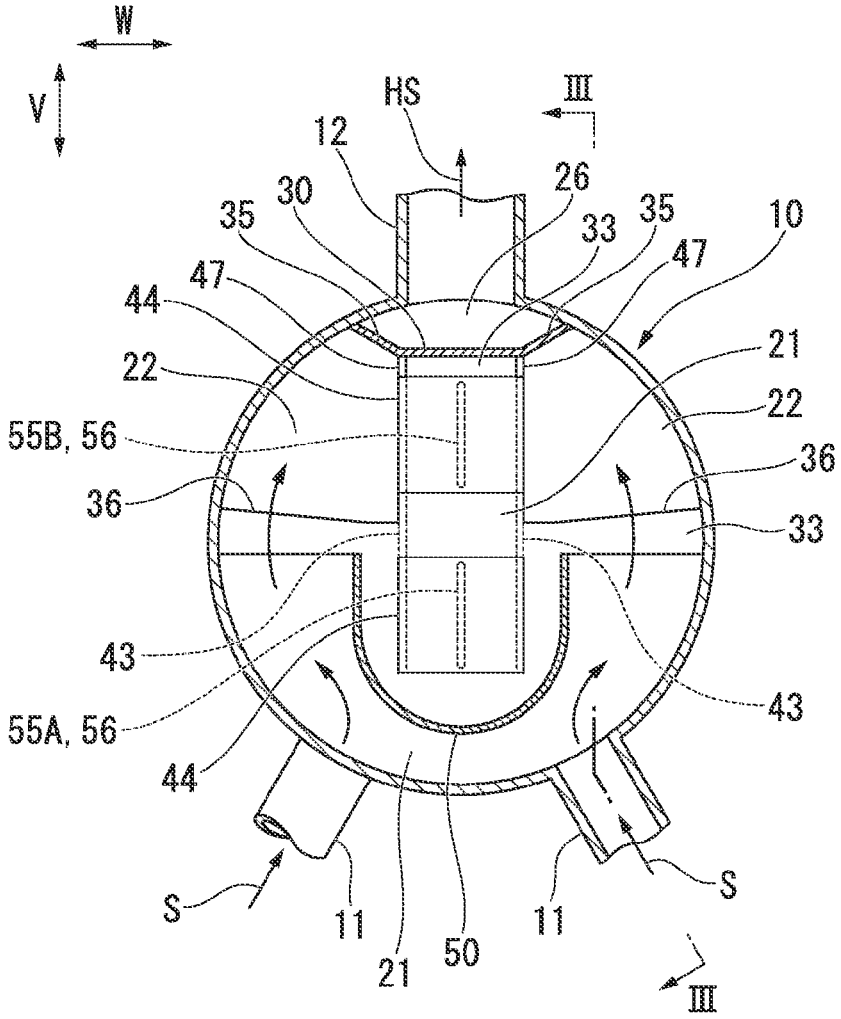
FIG. 2 is a sectional view along line II-II in FIG. 1.
Figure 3:
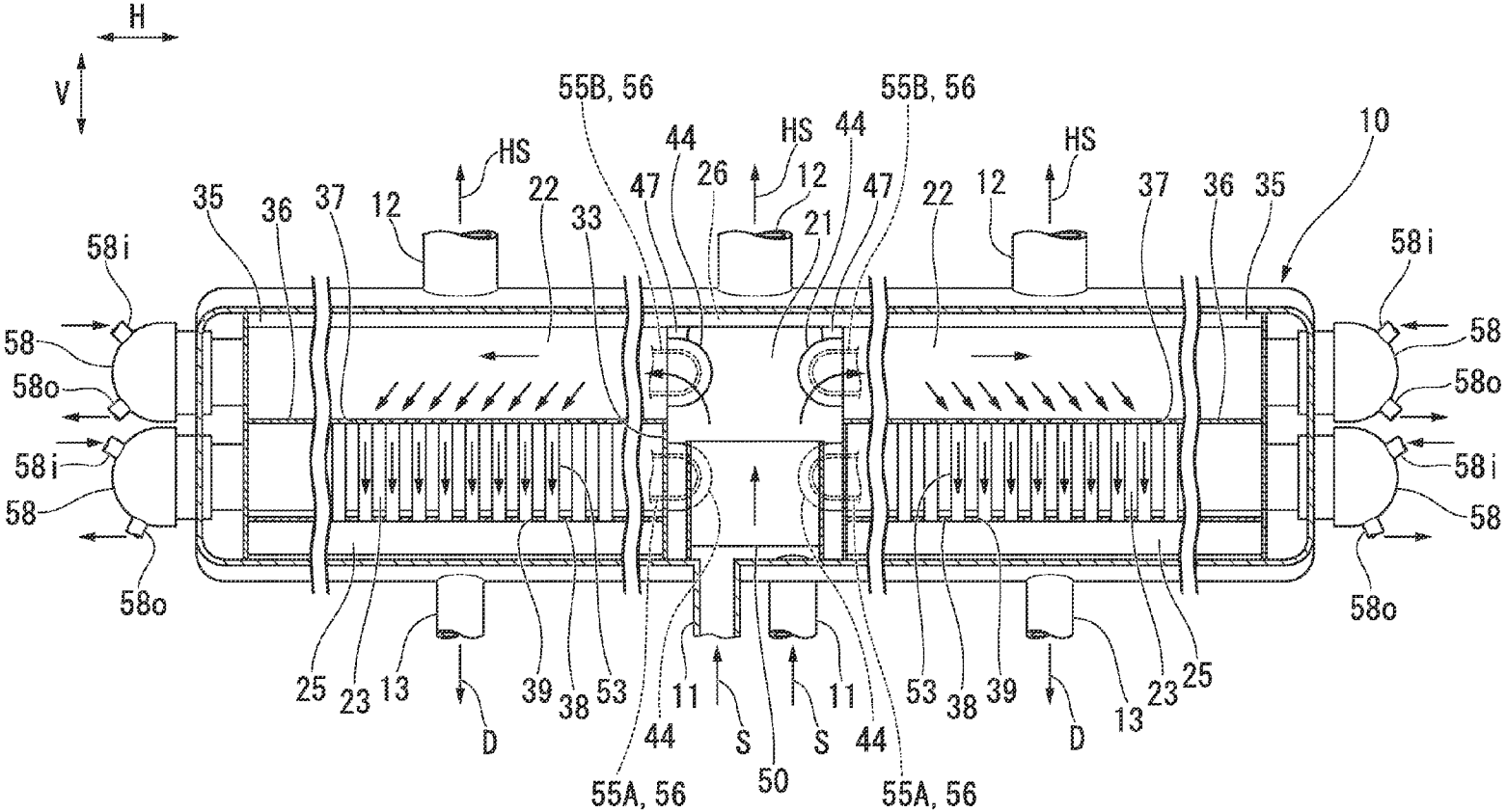
FIG. 3 is a sectional view along line III-III in FIG. 2.
Figure 4:
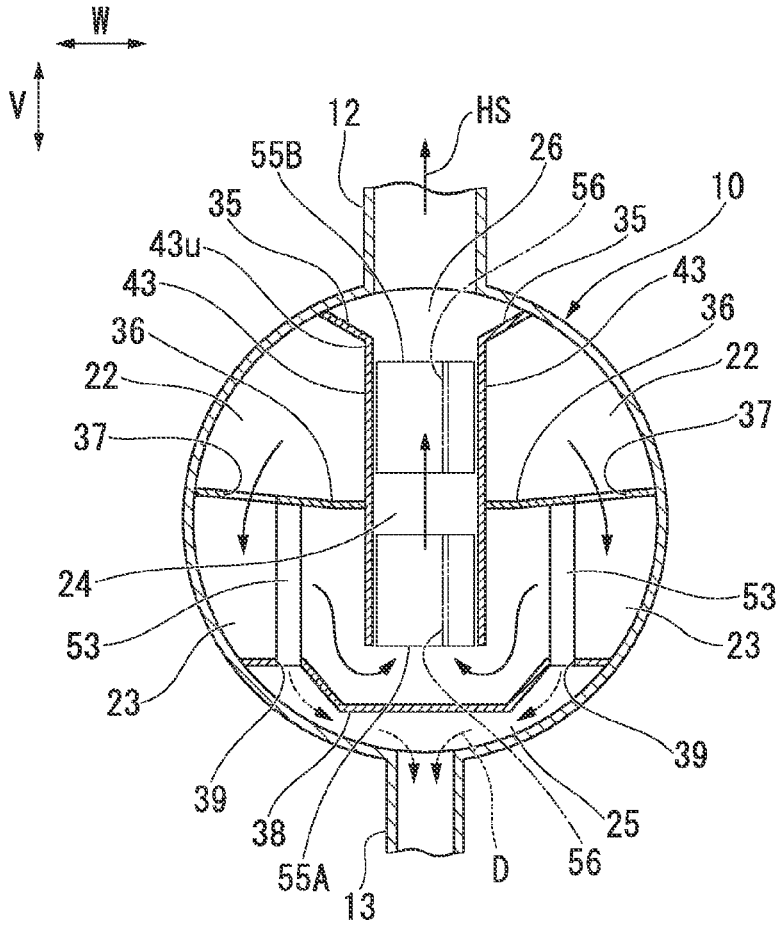
FIG. 4 is a sectional view along line IV-IV in FIG. 1.

As shown in FIG. 1 to FIG. 4, the moisture separator and reheater includes a cylindrical casing 10 into which steam S enters, and heat exchanger tube groups 55A and 55B that heat the steam S entering into the casing 10. FIG. 2 is a sectional view along line II-II in FIG. 1, FIG. 3 is a sectional view along line III-III in FIG. 2, and FIG. 4 is a sectional view along line IV-IV in FIG. 1.

The casing 10 extends in a horizontal axial direction H, and opposite ends thereof in the axial direction H are sealed. Hereinafter, a horizontal direction perpendicular to the axial direction H is denoted as a width direction W.

In the casing 10 there are formed; a steam receiving port 11 that receives steam S into the casing 10, a plurality of steam discharge ports 12 that discharge superheated steam HS subjected to moisture separation and heated in the casing 10, and a plurality of steam drain discharge ports 13 for discharging steam drain D from inside the casing 10. The steam receiving port 11 is formed in a lower part of the casing 10 and at the center in the axial direction H. The plurality of steam drain discharge ports 13 are formed in the lower part of the casing 10 and on opposite sides of the steam receiving port 11 in the axial direction H. The plurality of steam discharge ports 12 are formed in a line in the axial direction H in the upper part of the casing 10. One steam discharge port 12 of the plurality of steam discharge ports 12 is formed at the center in the axial direction H, similarly to the steam receiving port 11.

Inside the casing 10 are formed a steam receiving chamber 21 into which steam S flowing from the steam receiving port 11 enters, a supply manifold chamber 22 communicating with the steam receiving chamber 21 and adjacent to opposite sides of the steam receiving chamber 21 in the axial direction H (FIG. 3 and FIG. 4), a moisture separating chamber 23 communicating with the supply manifold chamber 22 and adjacent to a lower side of the supply manifold chamber 22 (FIG. 3 and FIG. 4), a heating chamber 24 communicating with the moisture separating chamber 23 and housing heat exchanger tube groups 55A and 55B, a steam drain collecting chamber 25 communicating with the moisture separating chamber 23 and adjacent to the moisture separating chamber 23 and a lower side of the heating chamber 24 (FIG. 3 and FIG. 4), and a steam collection manifold chamber 26 communicating with the heating chamber 24 and the steam discharge ports 12 and adjacent to the supply manifold chamber 22 and an upper side of the heating chamber 24 (FIG. 1 to FIG. 4).

As shown in FIG. 1, the steam collection manifold chamber 26 is formed on the upper part of the casing 10 substantially over the whole axial direction H of the casing 10. On the other hand, the steam receiving chamber 21 is formed at the center in the axial direction H of the casing 10, adjacent to the lower side of the steam collection manifold chamber 26. The steam collection manifold chamber 26 and the steam receiving chamber 21 are separated by a ceiling panel 30.

The supply manifold chamber 22, the moisture separating chamber 23, the heating chamber 24, and the steam drain collecting chamber 25 are adjacent to the opposite sides of the steam receiving chamber 21 in the axial direction H as shown in FIG. 1 and FIG. 3. As shown in FIG. 4, at a position shifted from the steam receiving chamber 21 in the axial direction H, the heating chamber 24 is formed at the center in the width direction W, the supply manifold chamber 22 is formed on the opposite sides of the heating chamber 24 in the width direction W, and the moisture separating chamber 23 is formed on the opposite sides of the heating chamber 24 in the width direction and at the lower side of the supply manifold chamber 22. At a position shifted from the steam receiving chamber 21 in the axial direction H, the steam collection manifold chamber 26 is formed on the upper side of the heating chamber 24 and the supply manifold chamber 22, and the steam drain collecting chamber 25 is formed on the lower side of the heating chamber 24 and the moisture separating chamber 23.

Of the supply manifold chamber 22, the moisture separating chamber 23, the heating chamber 24, and the steam drain collecting chamber 25 that are adjacent to the steam receiving chamber 21 in the axial direction H, the moisture separating chamber 23, the heating chamber 24, and the steam drain collecting chamber 25 are, as shown in FIG. 1 to FIG. 3, separated from the steam receiving chamber 21 by a transverse partition panel 33. The transverse partition panel 33 does not separate between the supply manifold chamber 22 and the steam receiving chamber 21, but opens for communicating with the steam receiving chamber 21.

As shown in FIG. 4, the supply manifold chamber 22 is separated from the steam collection manifold chamber 26 which is adjacent to the upper side of the supply manifold chamber 22 by a tilted plate 35. The tilted plate 35 gradually tilts toward the upper side with distance from the center thereof in the width direction W, and the farthest end thereof from the center is bonded to an inner surface of the casing 10.

Figure 5:
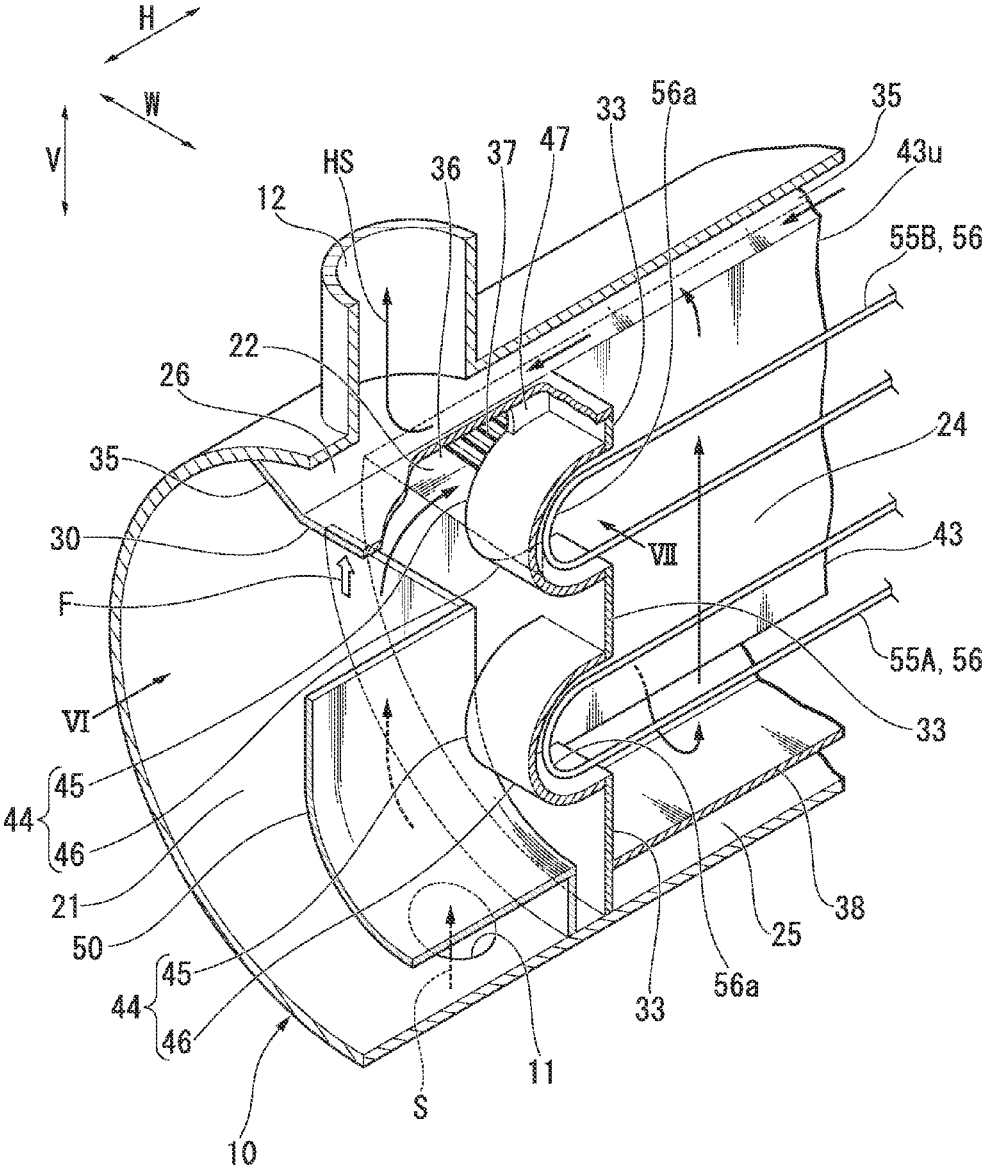
FIG. 5 is a cutaway perspective view of a main part of the moisture separator and reheater according to the embodiment of the present invention.

The moisture separating chamber 23 is separated between the moisture separating chamber 23 and the supply manifold chamber 22 which is adjacent to the upper side of the moisture separating chamber 23 by a distributor plate 36. A plurality of slits 37 penetrating the distributor plate 36 in a vertical direction V and long in the width direction W are formed in the distributor plate 36. The steam drain collecting chamber 25 is separated from the heating chamber 24 and the moisture separating chamber 23 adjacent to the upper side of the steam drain collecting chamber 25 by a bottom plate 38. The heating chamber 24 is separated from the supply manifold chamber 22 and the moisture separating chamber 23 adjacent to the opposite sides of the heating chamber 24 in the width direction W by a vertical partition panel 43. As shown in FIG. 5, an end edge in the axial direction H of the ceiling panel 30 that separates between the steam collection manifold chamber 26 and the steam receiving chamber 21 is bonded to an upper end 43*u* of the vertical partition panel 43. Moreover, as shown in FIG. 4 to FIG. 7, a central end of the tilted plate 35 that separates between the supply manifold chamber 22 and the steam collection manifold chamber 26 is bonded to the upper end 43*u* of the vertical partition panel 43. Furthermore, a central end of the distributor plate 36 that separates between the moisture separating chamber 23 and the supply manifold chamber 22 is bonded to the center of the vertical partition panel 43 in the vertical direction V.

As shown in FIG. 1, FIG. 2, and FIG. 5, a baffle plate 50 is arranged in the steam receiving chamber 21, with its sectional shape perpendicular to the axial direction H being a U-shape and a portion corresponding to a curved portion of the U-shape facing downward.

As shown in FIG. 3 and FIG. 4, a mist separator 53 is arranged in the moisture separating chamber 23. The mist separator 53 is a plurality of corrugated plates (not shown) arranged at regular intervals in the axial direction H, and a baffle plate (not shown) is provided at each peak of the plurality of corrugated plates so as to oppose the flow of the steam S. All the peaks and valleys of the plurality of corrugated plates extend in the vertical direction V. An opening 39 penetrating in the vertical direction V is formed in the bottom plate 38 that separates between the moisture separating chamber 23 and the steam drain collecting chamber 25 at a position corresponding to the valleys of the plurality of corrugated plates constituting the mist separator 53.

As shown in FIG. 1, as the heat exchanger tube groups 55A and 55B housed in the heating chamber 24, there are a first heat exchanger tube group 55A arranged in the lower part of the heating chamber 24 and a second heat exchanger tube group 55B arranged in the upper part of the heating chamber 24. The heat exchanger tubes constituting the respective heat exchanger tube groups 55A and 55B are U-tubes 56. A curved end 56*a* of the U-tube 56 is directed toward the center of the casing 10 in the axial direction H, and a tube end 56*b* of the U-tube 56 is directed toward the end of the casing 10 in the axial direction H. The tube end 56*b* of the U-tube 56 protrudes outward of the casing 10, and is fixed to a tube plate 57. A side of the tube plate 57 opposite to the U-tube 56 is covered with a hood 58, and a space is formed between the tube plate 57 and an inner surface of the hood 58. The space is vertically separated by a partition panel 59, and an upper space forms a steam receiving chamber 59*a* and a lower space forms a steam collection chamber 59*b*. A steam inlet 58*i* that allows the steam receiving chamber 59*a* to communicate with outside, and a steam outlet 58*o* that allows a steam collection chamber 58*b* to communicate with outside are formed in the hood 58.

Figure 6:
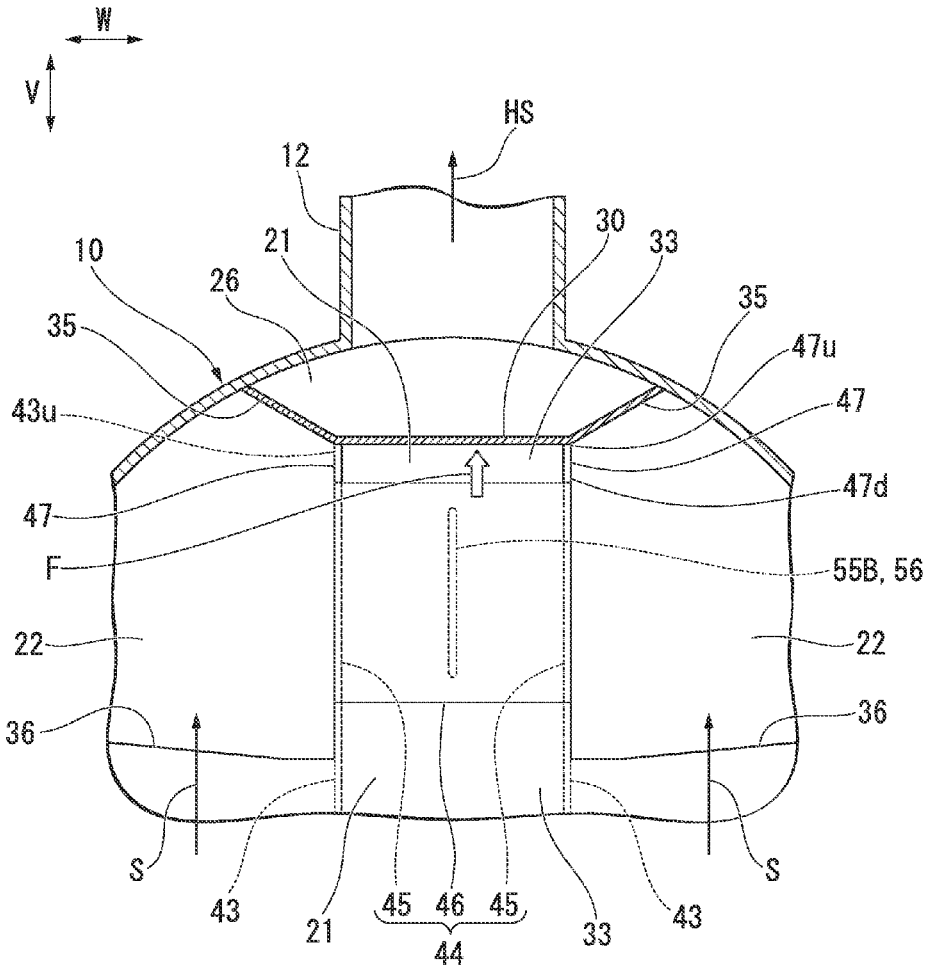
FIG. 6 is a view on arrow VI in FIG. 5.
Figure 7:
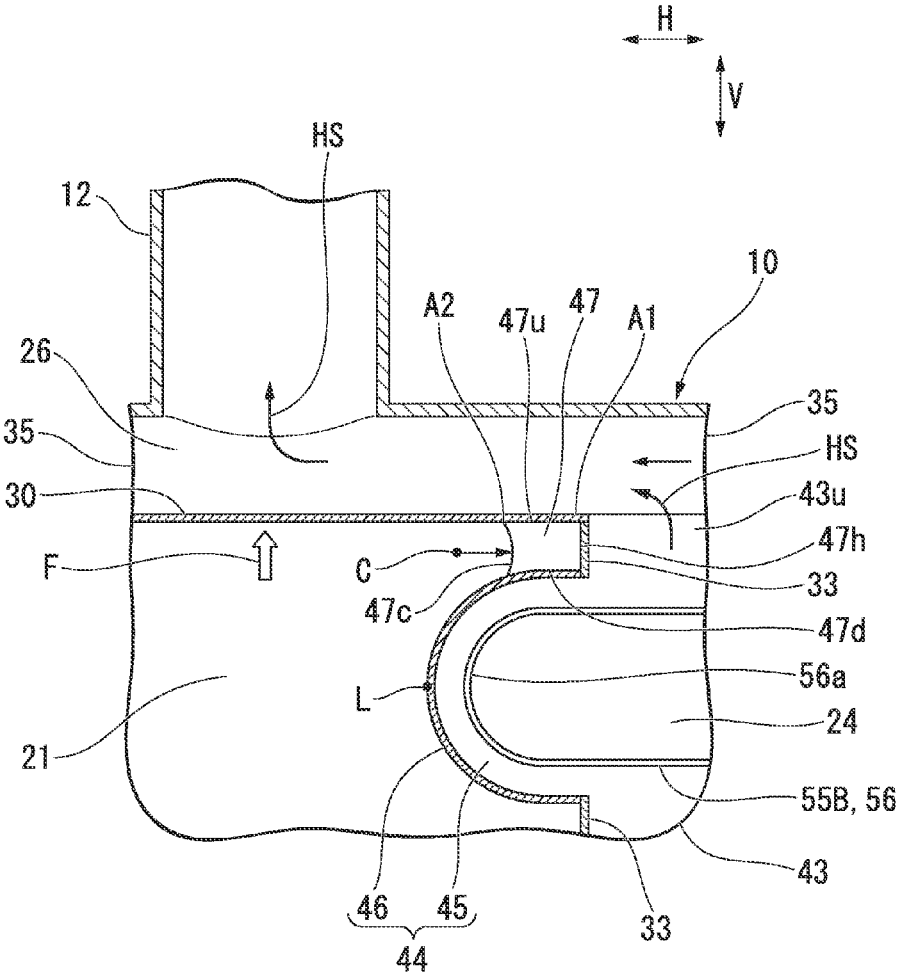
FIG. 7 is a view on arrow VII in FIG. 5.

The curved end 56*a* of the U-tube 56 constituting the respective heat exchanger tube groups 55A and 55B penetrates the transverse partition panel 33 in the axial direction H, is positioned further to the central side of the casing 10 in the axial direction H than the transverse partition panel 33 and the end of the ceiling panel 30 in the axial direction H, and is covered with a shroud 44. As shown in FIG. 5 to FIG. 7, the shroud 44 includes a pair of side shrouds 45 facing each other in the width direction W, and a connecting shroud 46 that connects edges of the pair of side shrouds 45 to each other. The pair of side shrouds 45 forms a circular arc shape in which an edge on the central side in the axial direction H protrudes to the central side. Consequently, the connecting shroud 46 that connects the edges on the central side of the pair of side shrouds 45 forms a circular arc shape, with a sectional shape thereof protruding toward the center. Edges of the shroud 44 on the end side of the casing 10 in the axial direction H are bonded to the transverse partition panel 33.

The steam receiving chamber 21 and the heating chamber 24 are separated by the shroud 44 and the transverse partition panel 33.

As shown in FIG. 5 to FIG. 7, a reinforcing panel 47 is arranged between the ceiling panel 30 and the side shroud 45 for the second heat exchanger tube group 55B in the steam receiving chamber 21. An upper edge 47*u* of the reinforcing panel 47 is bonded to the end of the ceiling panel 30 in the width direction W, and a lower edge 47*d* is bonded to the side shroud 45. Moreover, an end edge of the reinforcing panel 47 on the heating chamber 24 side in the axial direction H (hereinafter, it is referred to as a heating chamber edge 47*h*) is bonded to the transverse partition panel 33. The other end edge of the reinforcing panel 47 in the axial direction H (hereinafter, it is referred to as a central edge 47*c*) forms a circular arc shape depressed toward the transverse partition panel 33 side in a plane extending in the vertical direction V. As shown in FIG. 7, the arc center C of the circular arc shape of the reinforcing panel 47 is positioned further on the transverse partition panel 33 side than a remote position L farthest from the transverse partition panel 33 in the shroud 44.

Next is a description of an operation of the moisture separator and reheater explained above.

As shown in FIG. 1, FIG. 2, and FIG. 5, for example, when steam S used in the high-pressure steam turbine flows into the steam receiving chamber 21 from the steam receiving port 11, the steam S is guided upward and to the opposite sides in the width direction W, and flows into the supply manifold chamber 22, while impact at the time of flowing into the steam receiving chamber 21 is alleviated by the baffle plate 50.

As shown in FIG. 3 and FIG. 4, the steam S flowing into the supply manifold chamber 22 flows into the moisture separating chamber 23 via the slits 37 in the distributor plate 36. In the moisture separating chamber 23, the steam S comes in contact with a plurality of corrugated plates, baffle plates, and the like constituting the mist separator 53, and moisture in the steam S is captured by the plurality of corrugated plates and the baffle plates to flow downward, and then flows into the steam drain collecting chamber 25 from the opening 39 in the bottom plate 38. Moisture flowing into the steam drain collecting chamber 25, that is, steam drain D, flows to the outside from the steam drain discharge port 13.

On the other hand, the steam S having passed through the mist separator 53 flows into the heating chamber 24, and is heated by the heat exchanger tube groups 55A and 55B to become superheated steam HS in the process of flowing upward in the heating chamber 24. The superheated steam HS flows into the steam collection manifold chamber 26 from the heating chamber 24, and then flows to the outside from the steam discharge port 12. The superheated steam HS flowing out from the moisture separator and reheater is delivered to, for example, the low-pressure steam turbine.

In the moisture separator and reheater of the embodiment, as shown in FIG. 5 to FIG. 7, the steam receiving chamber 21 having the highest pressure among the plurality of chambers in the casing 10 due to the steam S flowing therein, and the steam collection manifold chamber 26 having the lowest pressure among the plurality of chambers in the casing 10 due to the steam S flowing out, are adjacent to each other in the vertical direction V via the ceiling panel 30.

Consequently, the ceiling panel 30 is applied with a force F directed toward the steam collection manifold chamber 26, that is, directed upward due to a pressure difference between the steam receiving chamber 21 and the steam collection manifold chamber 26. When the ceiling panel 30 is applied with the force F, stress concentration occurs at a corner A1 (FIG. 7) where the ceiling panel 30 and the transverse partition panel 33 come in contact with each other. In the embodiment, the upper edge 47*u* of the reinforcing panel 47 is bonded to the ceiling panel 30, and the heating chamber edge 47*h* of the reinforcing panel 47 is bonded to the transverse partition panel 33, thereby dispersing the stress applied to the corner A1, where the ceiling panel 30 and the transverse partition panel 33 come in contact with each other, to a portion along the upper edge 47*u* and a portion along the heating chamber edge 47*h* of the reinforcing panel 47.

As described above, even when the upper edge 47*u* of the reinforcing panel 47 is bonded to the ceiling panel 30 and the heating chamber edge 47*h* of the reinforcing panel 47 is bonded to the transverse partition panel 33, stress can be alleviated. However, in the embodiment, because the lower edge 47*d* of the reinforcing panel 47 is further bonded to the side shroud 45 for the second heat exchanger tube group 55B, more stress can be alleviated. Moreover, in the embodiment, by bonding the lower edge 47*d* of the reinforcing panel 47 to the side shroud 45 having relatively high stiffness in the vertical direction V, time and labor for separately providing a member having stiffness with respect to the force in the vertical direction V applied from the reinforcing panel 47, in order to bond the lower edge 47*d* of the reinforcing panel 47 can be saved.

In the embodiment, the reinforcing panel 47 and the side shroud 45 are bonded together. However, if the reinforcing panel 47 and the side shroud 44 are integrally formed when the shroud 44 itself is newly manufactured, the number of parts can be reduced, while maintaining support stiffness of the reinforcing panel 47.

Here, the reinforcing panel 47 for reinforcing the ceiling panel 30 can be provided in the steam collection manifold chamber 26. However, an upper part of the steam receiving chamber 21 in the steam collection manifold chamber 26 becomes a flow path through which the superheated steam HS passes. If the reinforcing panel is arranged in this part, the reinforcing panel becomes a flow resistance to the superheated steam HS. On the other hand, in the embodiment, the reinforcing panel is arranged in the steam receiving chamber 21 surrounded by the ceiling panel 30, the transverse partition panel 33, and the side shroud 45 for the second heat exchanger tube group 55B, where the steam S flowing into the steam receiving chamber 21 stagnates. Therefore, even if the reinforcing panel 47 is arranged here, the reinforcing panel 47 does not become flow resistance to the steam S. Consequently, in the embodiment, the reinforcing panel 47 is arranged in the steam receiving chamber 21.

Moreover, in the embodiment, the central edge 47*c* of the reinforcing panel 47 is formed in a circular arc shape. However, the central edge 47*c* can be a shape linearly extending in the vertical direction V. In this case, the shape of the reinforcing panel 47 is a rectangular plate shape. Thus, even if the reinforcing panel is formed in the rectangular plate shape, if the upper edge 47*u* of the reinforcing panel is bonded to the ceiling panel 30, the heating chamber edge 47*h* of the reinforcing panel is bonded to the transverse partition panel 33, and the lower edge 47*d* of the reinforcing panel is bonded to the side shroud 45 for the second heat exchanger tube group 55B, stress applied to the corner A1 where the ceiling panel 30 and the transverse partition panel 33 come in contact with each other can be alleviated. However, in this case, stress relatively concentrates on a portion where the upper edge 47*u* of the reinforcing panel is bonded to the ceiling panel 30 and near the central edge 47*c* of the reinforcing panel, that is, a corner A2 (FIG. 7) between the upper edge 47*u* and the central edge 47*c* of the reinforcing panel 47.

In the embodiment, therefore, the central edge 47*c* of the reinforcing panel 47 is formed in a circular arc shape depressed toward the heating chamber 24.

In this manner, when the central edge 47*c* of the reinforcing panel 47 is formed in the circular arc shape depressed toward the heating chamber 24, the vicinity of the central edge 47*c* of the reinforcing panel 47 has a shape that is more easily deformed in the vertical direction V. Consequently, stress applied to the corner A2 near the central edge 47*c* of the reinforcing panel 47 can be released by this deformation, and stress applied to the corner A2 near the central edge 47*c* of the reinforcing panel 47 can be alleviated.

Here, in the embodiment, the arc center C of the circular arc shape of the reinforcing panel 47, as described above, is positioned further on the transverse partition panel 33 side than the remote position L farthest from the transverse partition panel 33 in the shroud 44. This is for bonding the entire lower edge 47*d* of the reinforcing panel 47 to the side shroud 45 and for decreasing the radius of the circular arc to some extent. The reason the radius of the circular arc is decreased is to increase the size and the amount of the central edge 47*c* of the reinforcing panel 47 to be depressed toward the heating chamber 24, so that the vicinity of the central edge 47*c* of the reinforcing panel 47 is more easily deformed in the vertical direction V with respect to the upward force.

As the shape of the central edge 47*c* of the reinforcing panel 47, it need not be the circular arc shape and it can be, for example, a smoothly curved concave shape or V-shape, so long as the central edge 47*c* is depressed toward the heating chamber 24. However, if the central edge 47*c* is formed in the V-shape, because stress concentrates at an apex of the V-shape, the smoothly curved concave shape is preferable, and the circular arc shape is more preferable, so that the stress is distributed to the entire central edge 47*c*.

BRIEF DESCRIPTION OF THE REFERENCE SYMBOLS

10 Casing
11 Steam receiving port
12 Steam discharge port
21 Steam receiving chamber
22 Supply manifold chamber
23 Moisture separating chamber
24 Heating chamber
25 Steam drain collecting chamber
26 Steam collection manifold chamber
30 Ceiling panel
33 Transverse partition panel
35 Tilted plate
36 Distributor plate
37 Bottom plate
43 Vertical partition panel
44 Shroud
45 Side shroud
46 Connecting shroud
47 Reinforcing panel
50 Baffle plate
53 Mist separator
55 Heat exchanger tube group
56 U-tube
56*a* Curved end of U-tube
56*b* Tube end of U-tube
S Steam
HS Superheated steam

The invention claimed is:

1. A moisture separator and reheater comprising:

a cylindrical casing extending in a horizontal axial direction, with opposite ends in the axial direction being sealed; and a heat exchanger tube group that heats steam entering into said casing, wherein a steam receiving port for receiving steam from outside is formed in a lower part of said casing, and a steam discharge port for discharging steam to outside is formed in an upper part of said casing, inside said casing there are formed:

a steam receiving chamber into which steam flowing in from said steam receiving port enters;

a supply manifold chamber communicating with said steam receiving chamber and adjacent to said steam receiving chamber in the axial direction;

a moisture separating chamber communicating with said supply manifold chamber and adjacent to a lower part of said supply manifold chamber for separating moisture from steam;

a heating chamber communicating with said moisture separating chamber, adjacent to said steam receiving chamber in the axial direction, and housing said heat exchanger tube group; and a collection manifold chamber communicating with said heating chamber and said steam discharge port and adjacent to said heating chamber and an upper part of said steam receiving chamber, wherein said steam receiving chamber, said heating chamber and said collection manifold chamber are separated by a transverse partition panel, a shroud and a ceiling panel, said transverse partition panel extends in a vertical direction, said heat exchanger tube group penetrates said transverse partition panel in the axial direction, and said transverse partition panel is disposed between said steam receiving chamber and said heating chamber, said shroud covers said end of said heat exchanger tube group penetrating said transverse partition panel, said ceiling panel is bonded to said transverse partition panel, and is disposed between said steam receiving chamber and said collection manifold chamber, in said steam receiving chamber, a reinforcing panel is bonded to said shroud or is integrally formed with a part of said shroud, said reinforcing panel includes a stress diffusion part for dispersing a force applied by a pressure difference between said steam receiving chamber and said collection manifold chamber, said stress diffusion part is bonded to a corner where said ceiling panel and said transverse partition panel come into contact with each other, said shroud has a side shroud, said reinforcing panel is bonded to said side shroud or integrally formed with said side shroud, an edge of said reinforcing panel is located on a side of said reinforcing panel opposite to said transverse partition panel, said edge having a circular arc shape depressed toward said transverse partition panel, and an arc center of the circular arc shape of said reinforcing panel is positioned closer to said transverse partition panel than a remote position farthest from said transverse partition panel in said shroud to which said reinforcing panel is bonded.

2. A moisture separator and reheater according to claim 1, wherein said shroud has another side shroud, said side shroud and said other side shroud being a pair of side shrouds facing each other on opposite sides in a widthwise horizontal direction perpendicular to the axial direction with ends of said heat exchanger tube group as a reference, and said shroud has a connecting shroud that connects edges of the pair of side shrouds to each other.

* * * * *